US011965295B1

(12) United States Patent
Neusch

(10) Patent No.: US 11,965,295 B1
(45) Date of Patent: Apr. 23, 2024

(54) PORTABLE VEHICLE BARRIER

(71) Applicant: Neusch Innovations, LP, Burnet, TX (US)

(72) Inventor: William H. Neusch, Marble Falls, TX (US)

( * ) Notice: Subject to any disclaimer, the term of this patent is extended or adjusted under 35 U.S.C. 154(b) by 0 days.

(21) Appl. No.: 17/948,229

(22) Filed: Sep. 20, 2022

Related U.S. Application Data

(63) Continuation of application No. 17/158,174, filed on Jan. 26, 2021, now Pat. No. 11,447,919, which is a continuation of application No. 16/011,860, filed on Jun. 19, 2018, now Pat. No. 10,900,181.

(60) Provisional application No. 62/522,035, filed on Jun. 19, 2017.

(51) Int. Cl.
*E01F 13/12* (2006.01)
*E01F 13/06* (2006.01)

(52) U.S. Cl.
CPC ..... *E01F 13/12* (2013.01); *E01F 13/06* (2013.01)

(58) Field of Classification Search
CPC ..... E01F 13/02; E01F 13/06; E01F 13/12; E06B 11/025
See application file for complete search history.

(56) References Cited

U.S. PATENT DOCUMENTS 5,466,088 A 11/1995 Nasatka
5,740,629 A * 4/1998 Fischer ..... E01F 13/06 256/73
5,987,816 A * 11/1999 Fischer ..... E01F 13/06 404/6
6,115,963 A 9/2000 Allardyce
6,119,399 A 9/2000 McCain
6,702,512 B1 * 3/2004 Reale ..... E01F 13/123 404/6
7,062,879 B2 6/2006 Wenzl
7,775,738 B2 8/2010 Darcy
8,182,069 B2 5/2012 Thompson
8,182,169 B2 * 5/2012 Thompson ..... E01F 13/123 404/9
8,292,538 B2 10/2012 Morgan
10,900,181 B2 * 1/2021 Neusch ..... E01F 13/12
11,384,493 B2 * 7/2022 Dickinson ..... E01F 13/12
11,447,919 B2 * 9/2022 Neusch ..... E01F 13/12
2003/0019158 A1 * 1/2003 Gagnon ..... E01F 13/06 49/227
2003/0159356 A1 8/2003 Russell
2007/0126598 A1 6/2007 Carter
(Continued)

OTHER PUBLICATIONS

DOS SD-STD-02.01, Revision A Draft, Test Method for Vehicle Crash Testing of Perimeter Barriers and Gates, Jan. 2003.
(Continued)

*Primary Examiner* — Gregory J Strimbu
(74) *Attorney, Agent, or Firm* — Bradley Arant Boult Cummings LLP; Henry L. Ehrlich

(57) ABSTRACT

A method of arresting a forward motion of a moving vehicle travelling on a surface includes moving a barrier beam to a position blocking a vehicle passage over a base plate that is positioned on the surface, contacting the moving vehicle with the barrier beam, and rotating the base plate due to the contacting the vehicle causing the base plate to contact an underside of the vehicle during the forward motion of the vehicle, lifting at least front wheels of the vehicle.

13 Claims, 18 Drawing Sheets

(56) References Cited

U.S. PATENT DOCUMENTS

| | | | | |
|---|---|---|---|---|
| 2009/0250674 | A1* | 10/2009 | Darcy | E01F 13/12 256/13.1 |
| 2013/0071182 | A1* | 3/2013 | Younce | G08G 1/095 404/6 |
| 2016/0002870 | A1 | 1/2016 | Younce | |
| 2018/0023263 | A1* | 1/2018 | Rothschild | E01F 13/12 404/6 |

OTHER PUBLICATIONS

ASTM F2656-07 Standard Test Method for Vehicle Crash Testing of Perimeter Barriers, Aug. 2007.

ASTM F3016/F3016M-19 Standard Test Method for Surrogate Testing of Vehicle Impact Protective Devices at Low Speeds, Sep. 2019.

* cited by examiner

PORTABLE VEHICLE BARRIER

BACKGROUND

This section provides background information to facilitate a better understanding of the various aspects of the disclosure. It should be understood that the statements in this section of this document are to be read in this light, and not as admissions of prior art.

Vehicle barrier systems are used to stop motor vehicles trying to forcibly gain access to a compound or facility. Anti-ram vehicle barriers (AVB) systems or vehicle security barriers (VSB) are configured to stop motor vehicles, such as trucks, which are intentionally crashed into the barrier in an attempt to breach the barrier. Passive barriers (e.g., fences, walls) are static after installation and deployment, in other words, passive barriers "never" allow vehicular access to certain areas, while active barriers (e.g., gates, drop arms, active wedges) control or limit vehicular access to a particular area.

Some anti-ram vehicle barriers are crash tested to ensure compliance with and obtain certification from a recognized standard. For example, the American Standard Test Method (ASTM F2656 Standard Test Method for Vehicle Crash Testing of Perimeter Barriers), British Standard Institute (PAS 68) and the International Organization for Standardization (ISO) and International Works Agreement (IWA 14-1).

The U.S. State Department (DOS) published the certification standard SD-STD-02.01 (Test Method for Vehicle Crash Testing of Perimeter Barriers and Gates) in 1985. The test vehicle was specified as a medium-duty truck weighing 15,000 lb (6800 kg) and the nominal velocities were 30 mph (50 km/hr), 40 mph (65 km/hr) and 50 mph (80 km/hr). Penetration was measured from the pre-impact attack (front) side of the vehicle security barrier (VSB) and classified into three categories of penetration rating. In 2003, the standard was revised with measuring the penetration from the asset or protected (rear) side of the barrier and the limitation of permissible vehicle penetration to one meter (the highest level of penetration rating).

In 2007, the SD-STD-02.01 was replaced with ASTM F2656-07. This new standard included the medium-duty truck and added three new test vehicle types, a small passenger car, pickup truck, and heavy good truck. ASTM F2656-07 maintained three predetermined impact velocities for each vehicle category and the penetration is measured from the rear face of the barrier and classified into four categories of penetration rating. ASTM F2656 was revised in 2015 (ASTM F2656-15) to include two additional vehicle types, a full-sized sedan and a cab over/cab forward class 7 truck and it excluded the lowest penetration rating (P4).

The vehicle rating is designated with a prefix indicating the test vehicle weight: "M" prefix designates a medium duty vehicle with a gross weight of 15,000 pounds (6,810 kg), "C" prefix designates a car having a vehicle weight of 2,430 pounds (1,100 kg), "PU" prefix designates a pickup having a vehicle weight of 5,070 pounds (2,300 kg), and "H" prefix designates a heavy goods vehicle having a vehicle weight of 65,000 pounds (29,500 kg). The penetration ratings include P1 for less than or equal to 1 meter (3.3 ft); P2 for 1.10 to 7 m (3.31 to 23.0 ft); P3 for 7.01 to 30 m (23.1 to 98.4 ft); and, prior to 2015, P4 for 30 m (98 ft) or greater.

An ASTM F2656 crash tested vehicle barrier is rated based on the test vehicles weight (e.g., M, C, PU, H), the speed (miles per hour) of impact (e.g., 30, 40, 50, 60), and the penetration (P1, P2, P3, and P4) of the vehicle. For example, an M50-P1 crash barrier is designed to stop a medium duty truck traveling 50 mph with a penetration distance of 3.3 feet or less.

In 2005, the British Standard Institute (BSI) published PAS 68:2005 Specification for Vehicle Barriers: Fixed Bollards. The standard was expanded within two years to include other types of barriers, such as gates and road blockers. The 2013 version, "Impact Test Specifications for Vehicle Security Barrier Systems," rates vehicle barrier systems based on six types of test vehicles, including seven test speeds, and penetration is measured from the rear (protected side) face of the barrier. PAS 68 defines the vehicle type, penetration, dispersion of debris and records the angle of the vehicle's approach. The PAS 68 rating includes a 5-to-7-part classification code, the includes: Classification of Test/Gross Weight of Vehicle (kg) (Vehicle Class)/Impact Speed/Angle of Impact: Distance Leading Edge of Load Bay travels beyond the Original Position of Rear Face/Dispersion Distance of major debris weighing 25 kg or more from the barrier to establish standoff distance. For example, a barrier (bollard) tested by impact by a 7500 kg day cab ("V") at a ninety-degree angle traveling 80 km/hr and resulting in penetration of 7.5 m with significant debris scattered up to 20.0 m away would be designated as V/7500 (N3)/80/90:7.5/20.0. The dispersion distance may be utilized to determine a standoff distance for example to mitigate damage from a vehicle born improvised explosive device (VBIED)

The European Committee for Standardization (CEN) recognized across 34 European countries has produced a standard CWA 16221 that combines details of BS PAS 68 and PAS 69. PAS 69 provides guidance on the barrier's use and installation.

In 2013, the International Works Agreement (IWA) 14-1: 2013 was published to provide an international specification for crash testing. The system was developed by government agencies, military bodies and providing companies from the USA, UK, Germany, Norway, Oman, Singapore, and Syria. This standard includes a merging of the British PAS 68 and the American ASTM F2656 vehicle impact test specifications. This international standard assesses vehicle barrier performance based on nine types of test vehicles with up to seven test speeds. Penetration is measured from the front (attack side) face of the vehicle safety barrier. The IWA 14-1 classification code represents Vehicle Impact Test/Gross Weight of Vehicle (Vehicle Class)/Impact Speed/Angle of Impact/Penetration beyond the original position of the front/impact face.

Entry through vehicle access points is often controlled by gates, such as drop arm gates, however, such access gates are not typically anti-ram crash-rated barriers. At secure locations, the vehicle gates are commonly permanent installations, which facilitate erecting a gate assembly that is secured in a below-grade foundation that can absorb the energy of an impacting vehicle and arrest the forward progress of the vehicle. Commonly, anti-ram type barriers are constructed as massive obstructions to function, by their own mass and/or positioning in the ground, as an immovable mass to stop an impacting vehicle.

SUMMARY

An exemplary method of arresting a forward motion of a moving vehicle travelling on a surface includes moving a barrier beam to a position blocking a vehicle passage over a base plate that is positioned on the surface, contacting the moving vehicle with the barrier beam, and rotating the base plate due to the contacting the vehicle causing the base plate to contact an underside of the vehicle during the forward motion of the vehicle, lifting at least front wheels of the vehicle.

Another exemplary method of arresting a forward motion of a moving vehicle travelling on a surface with a vehicle barrier that includes a base plate positioned on the surface and having a width extending laterally to define a vehicle passage between a first post and a second post and having a depth extending perpendicular to the width from a front edge of the base plate to a back edge of the base plate, the method including contacting the moving vehicle with a beam blocking the vehicle passage and rotating the base plate due to the contacting the vehicle causing the base plate to contact a frame of the vehicle during the forward motion of the vehicle, lifting at least front wheels of the vehicle.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
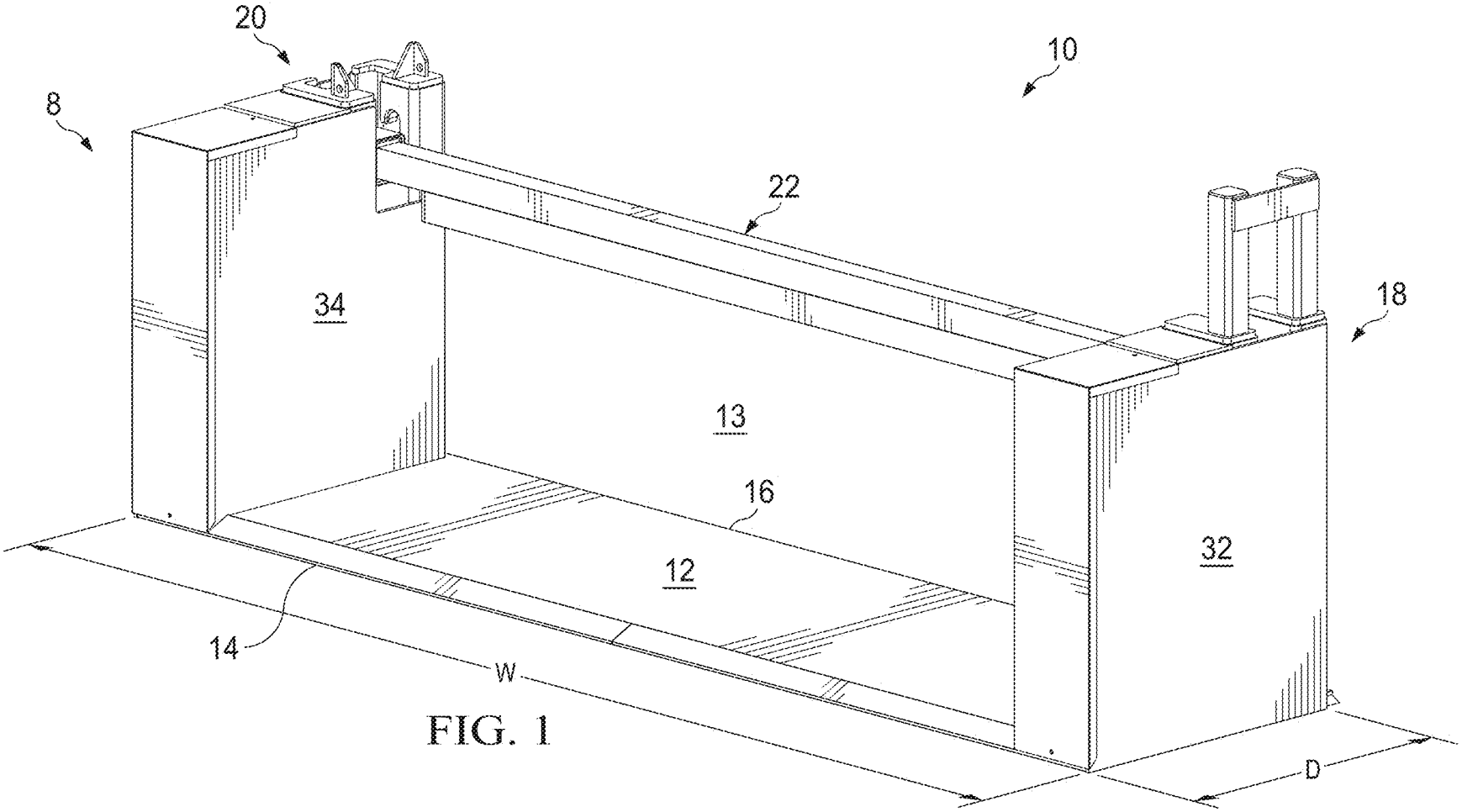
FIG. 1 is a perspective view of an example of a vehicle gate assembly according to one or more aspects of the disclosure.

It is to be understood that the following disclosure provides many different embodiments, or examples, for implementing different features of various embodiments. Specific examples of components and arrangements are described below to simplify the disclosure. These are, of course, merely examples and they are not intended to be limiting. For example, a figure may illustrate an exemplary embodiment with multiple features or combinations of features that are not required in one or more other embodiments and thus a figure may disclose one or more embodiments that have fewer features or different combination of features than the illustrative embodiment. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not in itself dictate a relationship between the various embodiments and/or configurations discussed.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include such elements or features. Further, the figures may illustrate exemplary embodiments that show features or combination of features that are not required in one or more embodiments and thus a specific figure may disclose one or more embodiments that have fewer features or different combination of features than those shown in the illustrated embodiment.

As used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements. Terms such as "up," "down," "top," and "bottom" and other like terms indicating relative positions to a given point or element may be utilized to describe some elements more clearly. Commonly, these terms relate to a reference point such as the ground level.

Portable gate assemblies are disclosed herein for positioning at vehicle access crossings into a protected area. The protected area may be a temporary or permanent area into which entry is limited, at least limited to motor vehicles through the one or more vehicle access locations. Non-limiting examples of protected areas include parking garages and surface parking areas, grounds for sporting events and celebrations, and high-security locations such as government, military and business installations and power generating and distribution installations.

Portable gate assemblies can be transported as a unit for example on a light or medium-duty truck and positioned at the vehicle access location to the protected area. Portable gate assemblies include assemblies that can be placed on a ground surface and utilized without being physically secured below the ground surface. Portable gate assemblies can also be secured on top of the ground surface and utilized as what is also known as a surface mounted gate, for example, a base (e.g., tread plate) may be placed on the ground surface and secured in place with fasteners. As will be understood by those skilled in the art with the benefit of the disclosure, aspects of the example portable gate assemblies can be utilized in active barrier systems that are erected on-site and secured in the ground foundation or a semi-permanent fixture associated with the ground foundation.

In accordance with embodiments of the disclosure, the portable gate assemblies are configured to provide a requisite stopping capability in the event that a motor vehicle, such as a 15,000 pounds (6.8 metric tons) medium-duty truck, crashes into the portable gate. In accordance with embodiments of the disclosure, a requisite stopping capability will be in accordance with standards established for example by ASTM F-2656, which identifies impact conditions including the vehicle weight, impact velocity, and penetration distance. With reference to a medium-duty truck, having a weight of about 15,000 lb (6,800 kg), the speed ratings include M30 for traveling at 28.0 to 37.9 miles per hour (mph), M40 traveling at 38.0 to 46.9 mph, and M50 traveling at 47.0 mph and above. The penetration ratings include P1 for less than or equal to 1 meter (3.3 ft); P2 for 1.10 to 7 m (3.31 to 23.0 ft); and P3 for 7.01 to 30 m (23.1 to 98.4 ft). For example, an ASTM F2656 crash-rated M50-P1 barrier is designed to stop a medium duty truck traveling 50 mph with a penetration distance of 3.3 feet or less.

In accordance with at least one embodiment, the portable gate assembly is configured to achieve an M30 speed rating with a P1 penetration rating. In accordance with at least one embodiment, the portable gate assembly is configured to achieve an M30 speed rating with a P2 penetration rating. In accordance with at least one embodiment, the portable gate assembly is configured to achieve a M30 speed rating with a P3 penetration rating.

In accordance with at least one embodiment, the portable gate assembly is configured to achieve an M40 speed rating with a P1 penetration rating. In accordance with at least one embodiment, the portable gate assembly is configured to achieve an M40 speed rating with a P2 penetration rating. In accordance with at least one embodiment, the portable gate assembly is configured to achieve an M40 speed rating with a P3 penetration rating.

In accordance with at least one embodiment, the portable gate assembly is configured to achieve an M50 speed rating with a P1 penetration rating. In accordance with at least one embodiment, the portable gate assembly is configured to achieve an M50 speed rating with a P2 penetration rating. In accordance with at least one embodiment, the portable gate assembly is configured to achieve an M50 speed rating with a P3 penetration rating.

Some embodiments may be configured to achieve similar speed and penetration ratings for impact vehicles such as cars having a weight up to about 2,430 lbs (1,100 kg) (e.g., C40, C50, C60) and heavy goods vehicles having a weight of about 65,000 lbs (29,500 kg) (e.g., H30, H40, H50).

FIG. 1 illustrates an example of a portable gate assembly 10 that is configured to achieve an ASTM-F2656 crash rating. The illustrated portable gate assembly 10 is described as a portable gate that is installed by placing on the surface of the ground (i.e., foundation) in a location to limit the entrance of motor vehicles into a protected area. In accordance with some embodiments, the portable gate assembly 10 is not secured to the ground surface. In accordance with some embodiment, the portable gate assembly 10 may be a surface-mounted gate that is secured to the surface of the ground foundation. In the illustrated figures, the portable gate assembly includes a movable barrier in the form of an arm (e.g., drop arm) that carries, for example, a cable or rope, however, it will be recognized that the arm may take other configurations. For example, and without limitation, the illustrated linear arm may be replaced with a U-shaped member to reduce the vertical clearance required to fully raise the barrier and allow a vehicle to pass. Installations such as parking garages may present vertical clearance limitations.

Figure 3:
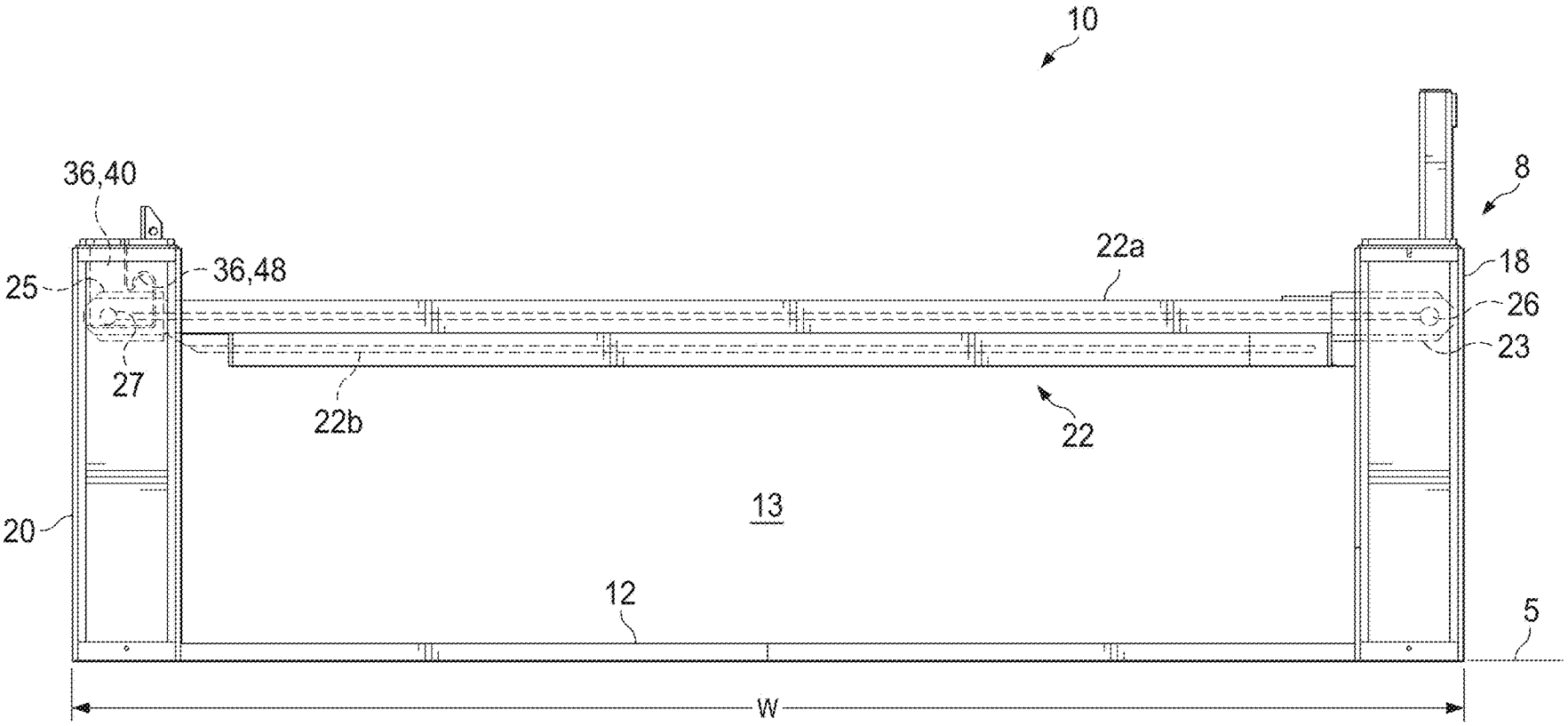
FIG. 3 is a front elevation view from the attack side of an exemplary vehicle gate assembly according to one or more aspects of the disclosure.
Figure 4:
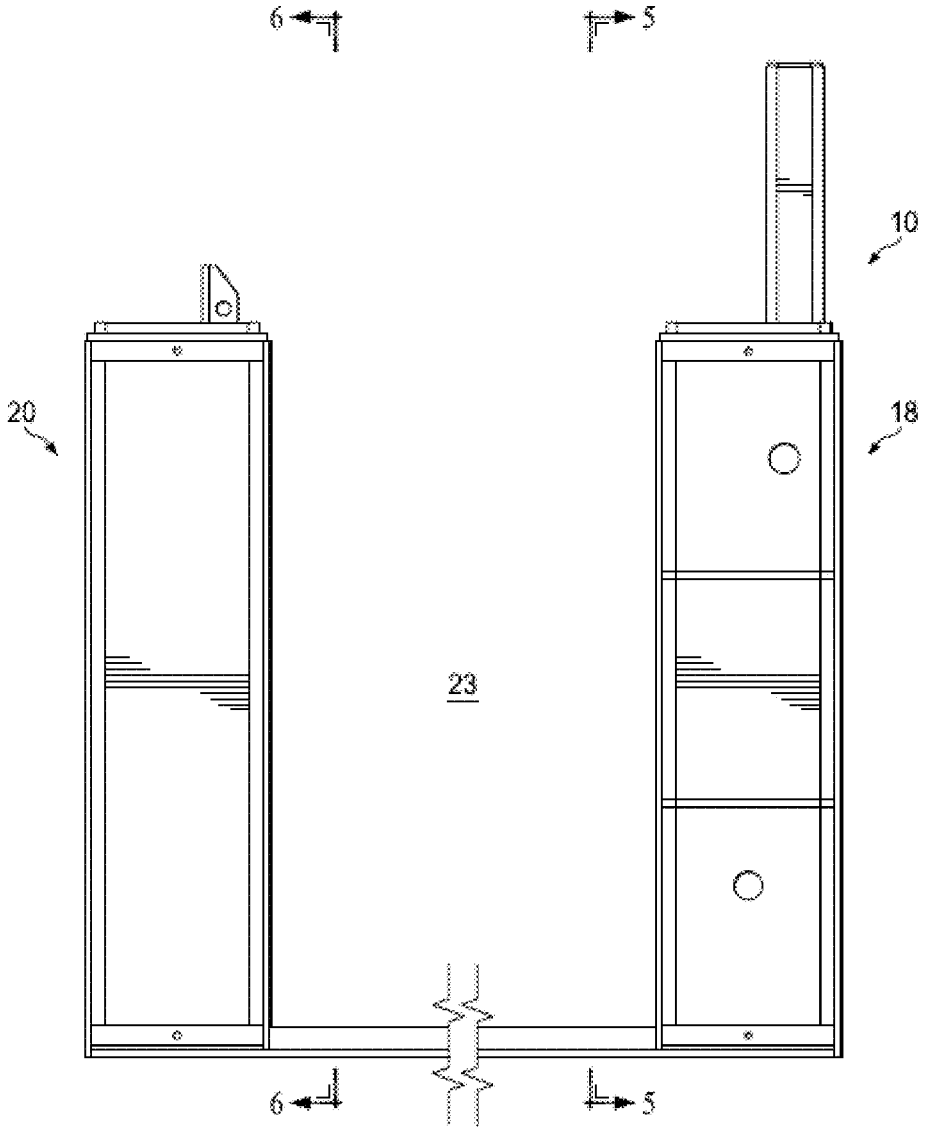
FIG. 4 is a front elevation view from the attack side of an exemplary vehicle gate assembly with the barrier removed according to one or more aspects of the disclosure.
Figure 5:
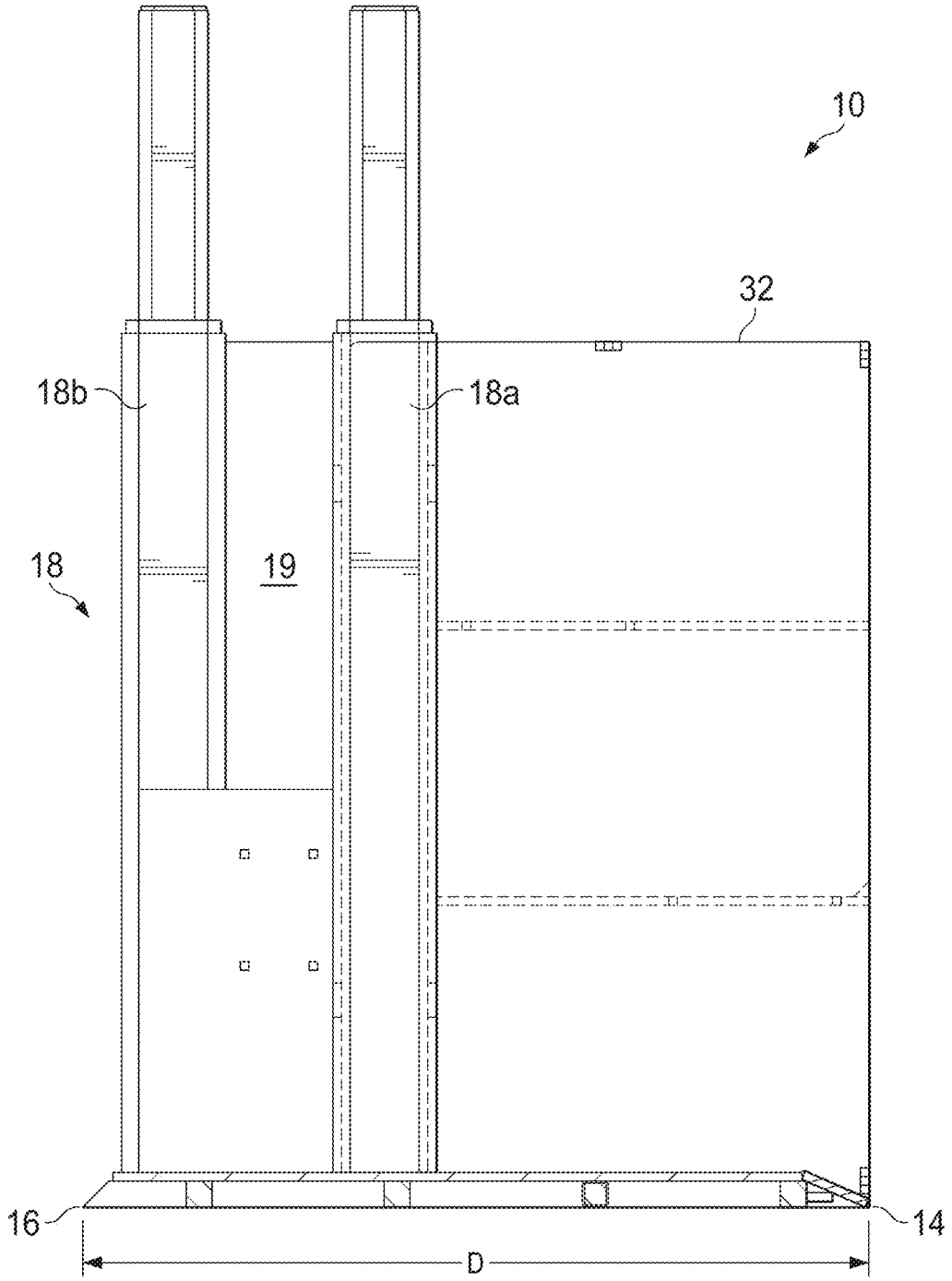
FIG. 5 is a view of the hinge post assembly along the line 5-5 of FIG. 4.
Figure 6:
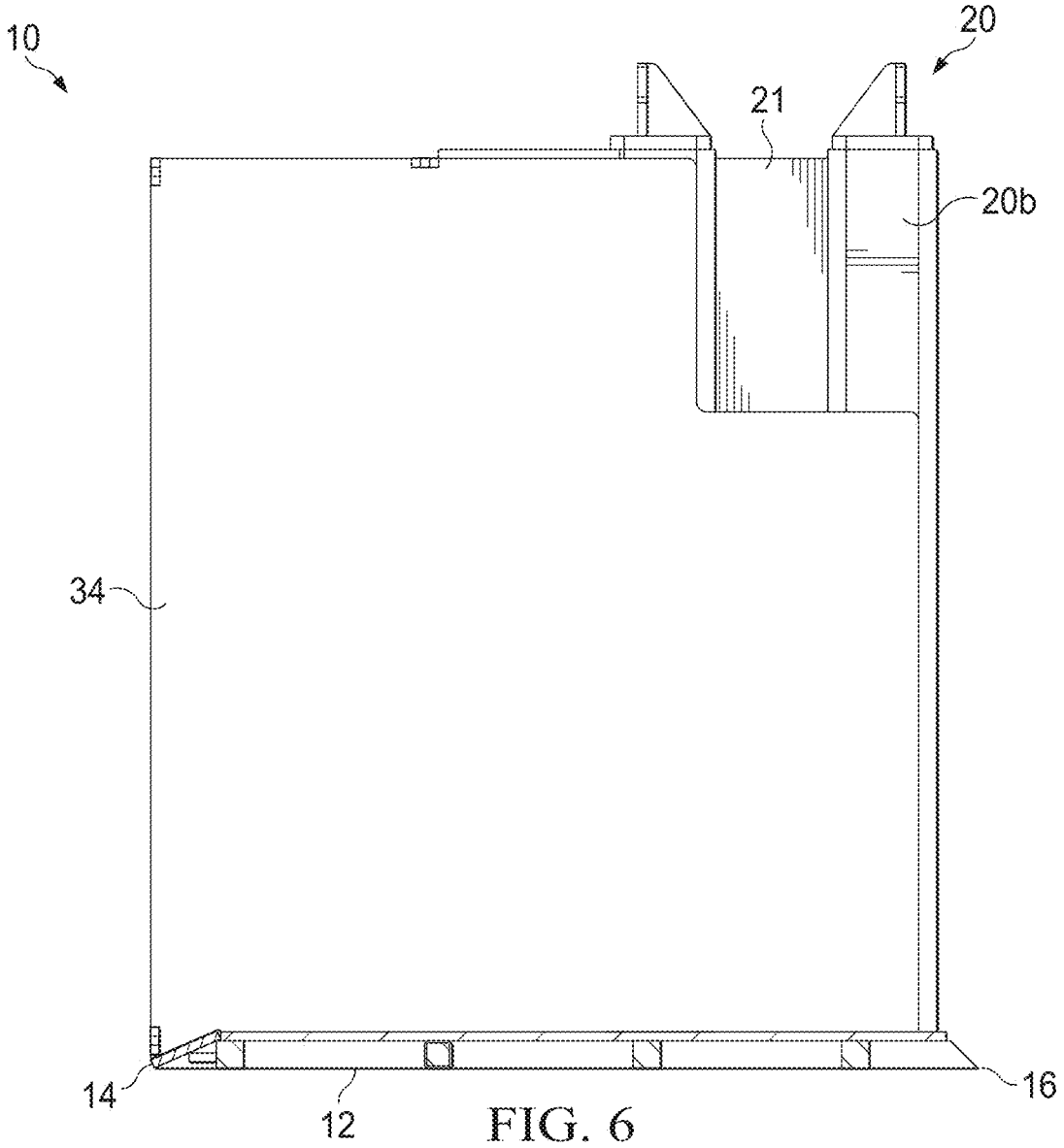
FIG. 6 is a view of the latch post assembly along the line 6-6 of FIG. 4.
Figure 7:
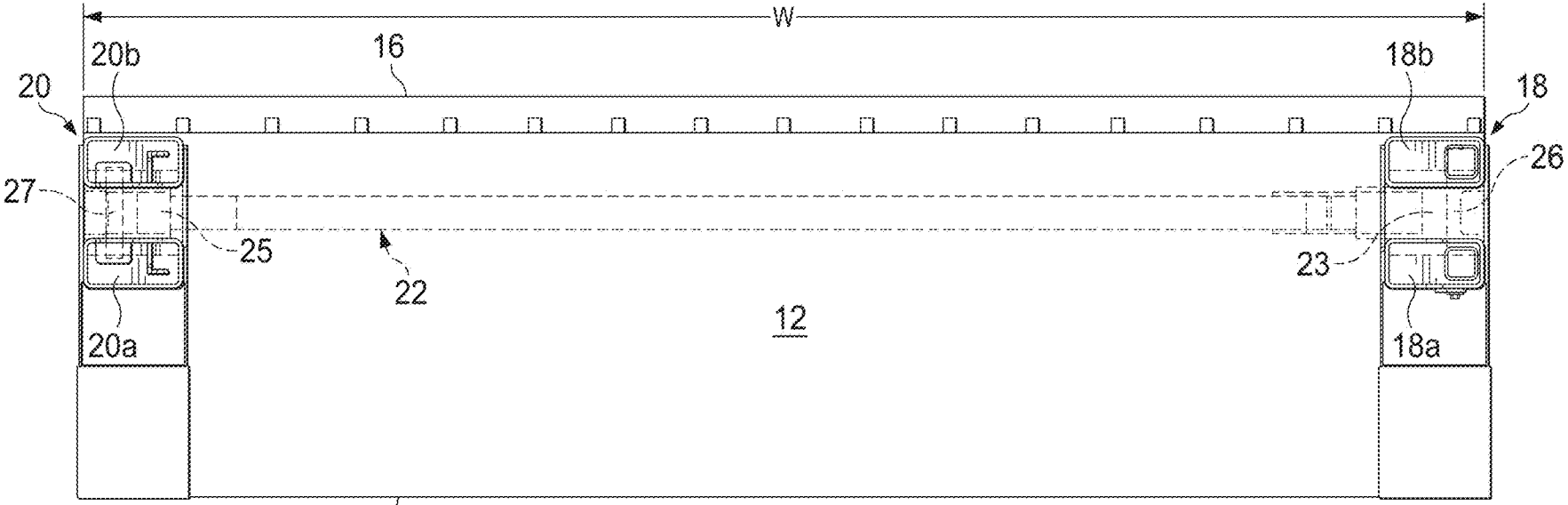
FIG. 7 is a plan view of an exemplary vehicle gate assembly according to one or more aspects of the disclosure.
Figure 8:
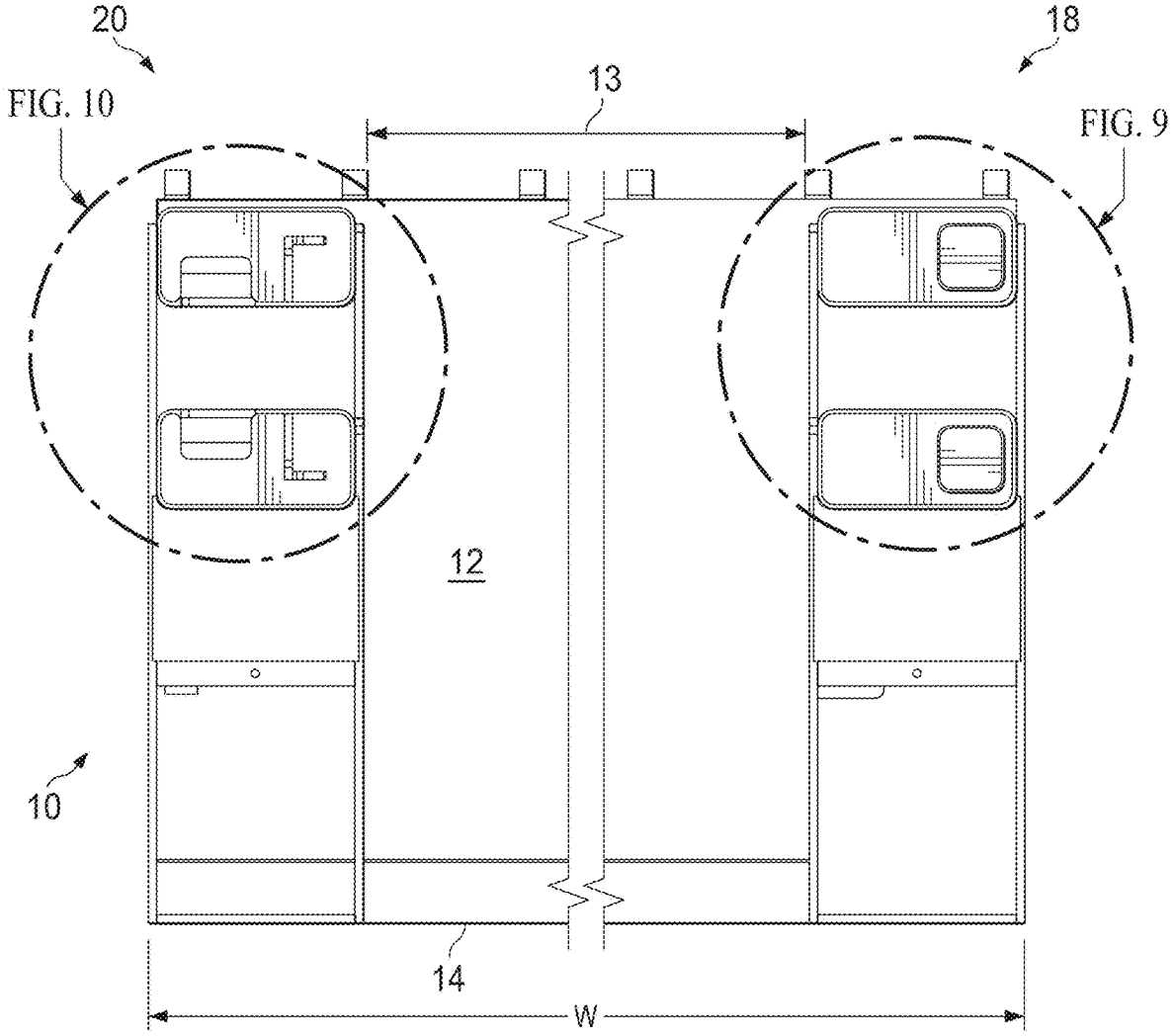
FIG. 8 is a plan view of an exemplary vehicle gate assembly with the barrier removed according to one or more aspects of the disclosure.
Figure 10:
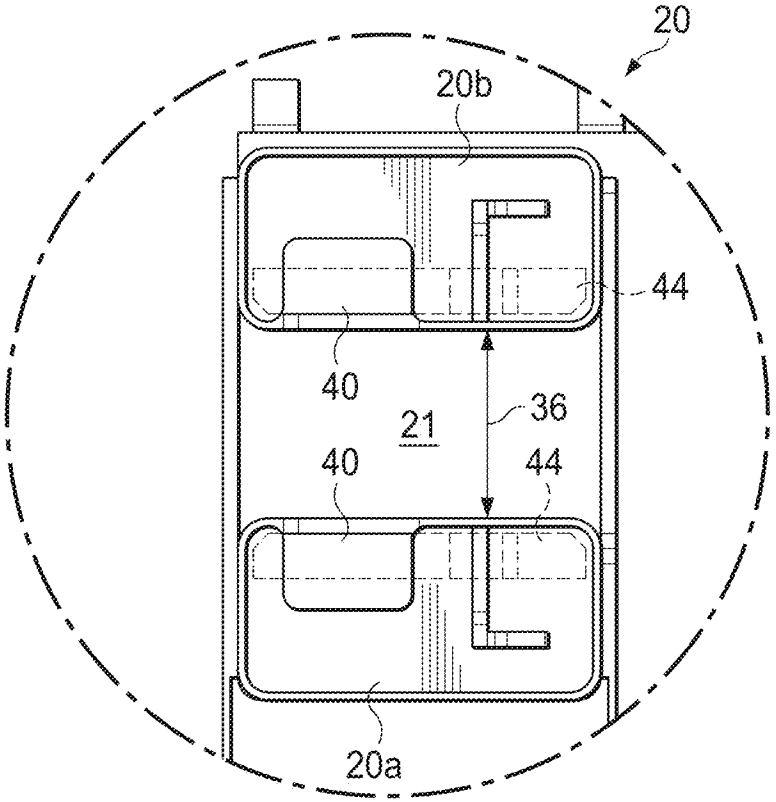
FIG. 10 is a plan view of the latch post assembly at detail "FIG. 10" of FIG. 8.
Figure 9:
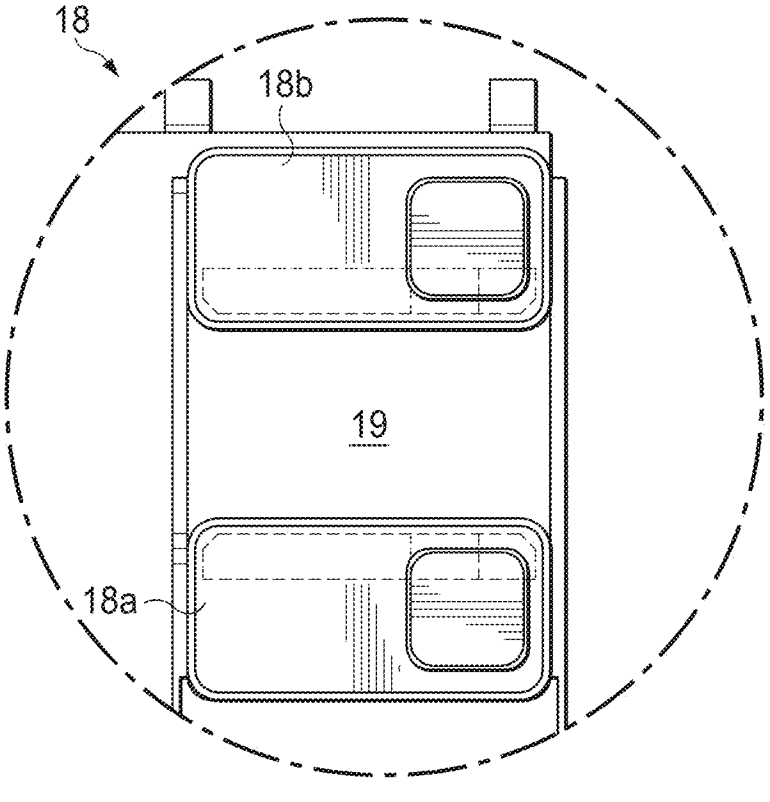
FIG. 9 is a plan view of the hinge post assembly at detail "FIG. 9" of FIG. 8.
Figure 22:
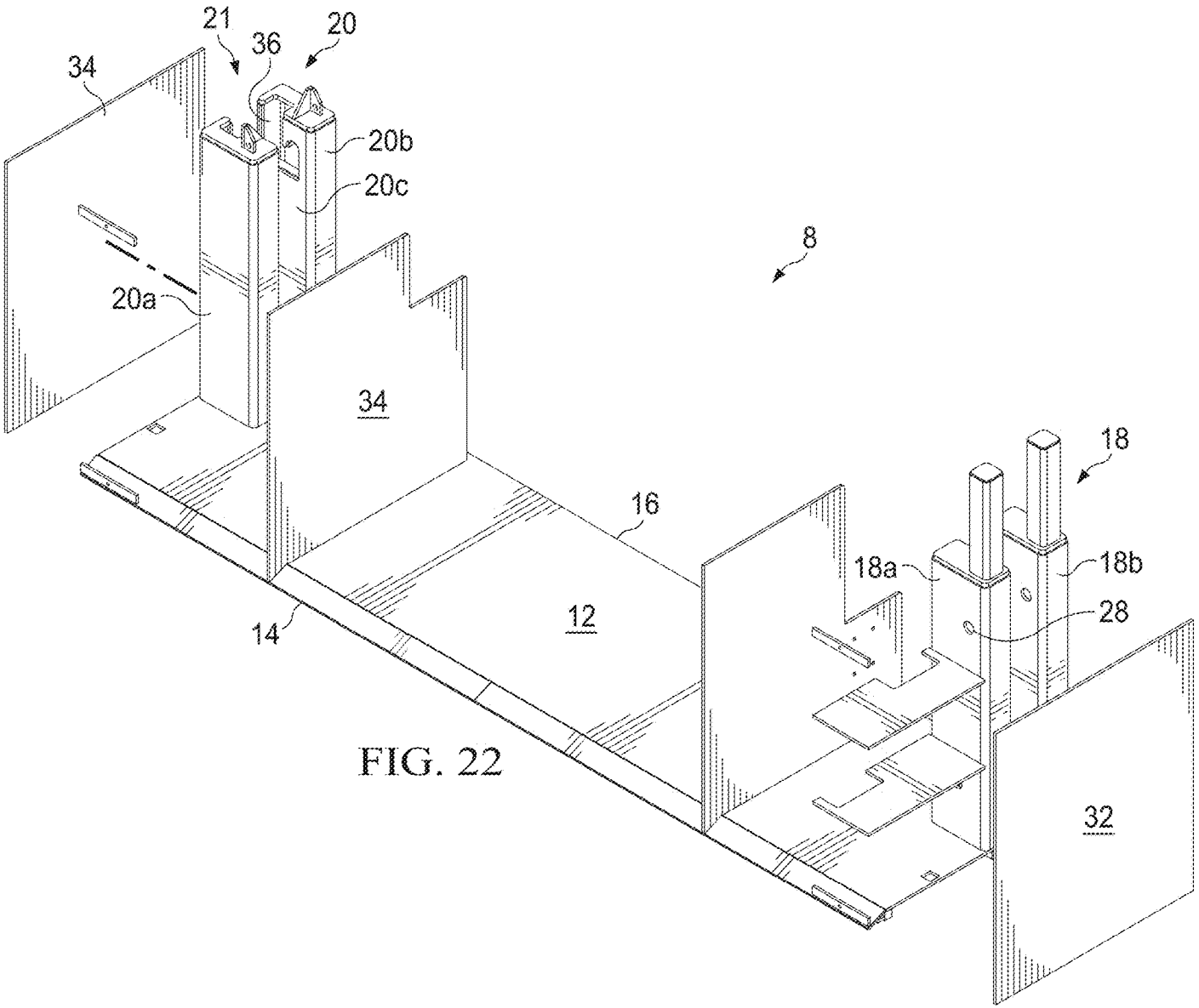
FIG. 22 is an exploded isometric view of an exemplary frame of a gate assembly according to one or more aspects of the disclosure.
Figure 23:
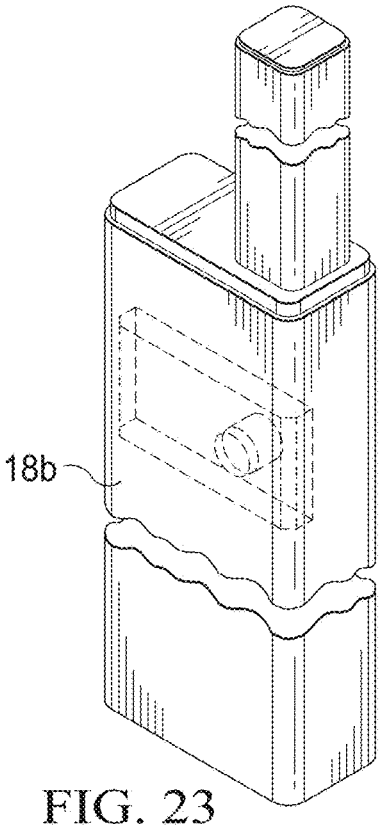
FIG. 23 illustrates an exemplary protected side hinge post of a hinge post assembly according to one or more aspects of the disclosure.
Figure 24:
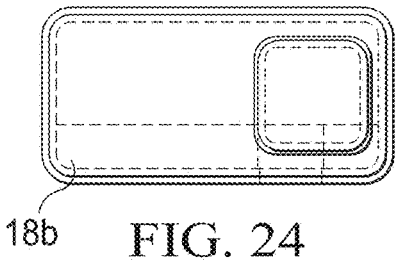
FIG. 24 is a top view of the exemplary protected side hinge post of FIG. 23.

Referring in particular to FIGS. 1, 3, and 22, a portable or surface-mounted active gate assembly 10 includes a frame 8 and a movable barrier 22. Frame 8 includes a base 12 having a longitudinal or lateral width "W" extending perpendicular to the direction of traffic flow to form a vehicle passage 13 and an axial depth "D" extending parallel to the traffic flow. Base 12 includes a laterally extending attack-side or threat-side edge 14 and a laterally extending protected-side edge 16. Threat- or attack-side edge 14 is the front edge of the base facing vehicles traveling in the direction toward the protected area and protected-side edge 16 is on the opposite side of base 12.

Figure 29:
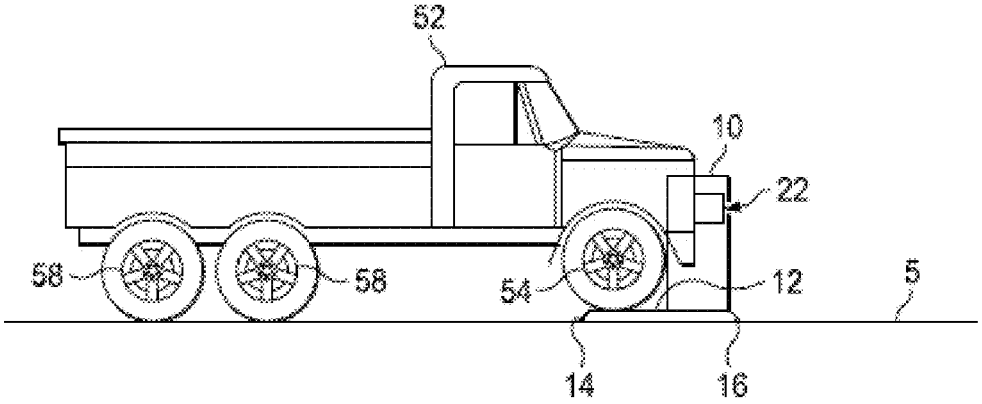
FIG. 29 illustrates an exemplary gate assembly according to one or more aspects of the disclosure relative to a motor vehicle approaching from an attack side.

Base 12 is placed on top of ground level 5 (FIG. 3) and includes, for example, a metal tread plate across which a motor vehicle can drive. In the illustrated example, the metal tread plate extends for example to a height of about 2 inches above ground level. Gate assembly 10 includes a hinge post assembly 18 and a latch post assembly 20 located at opposite lateral ends of base 12 to form vehicle passage 13 therebetween. In some of the illustrated embodiments, the width of vehicle passage 13 is about 12 feet. Gate assembly 10 includes a moveable barrier 22 pivotally connected at a first end 23 to hinge post assembly 18 and in the closed position, the second end 25 is positioned within a portion of latch post assembly 20. Moveable barrier 22 is located adjacent to and above protected-side edge 16 of base 12 on the opposite side of the base from attack-side edge 14. When a vehicle 52 impacts barrier 22, front wheels 54 will be located on base 12 as shown for example in FIGS. 29 and 30. If a vehicle approaches gate assembly 10 slowly in an effort to push gate assembly 10 as shown in FIG. 29, the front tires will be on base 12 and the weight of vehicle 52 will prevent vehicle 52 from moving gate assembly 10 out of position even if base 12 is not fastened to the ground surface.

Portable gate assembly 10 can be transported and delivered to the vehicle access location for example on the back of a flat-bed vehicle or in a trailer that may be towed behind a vehicle such as a car, pickup, light- or medium duty truck. Portable gate assembly 10 can be offloaded and positioned on top of the ground surface at the vehicle access location. Portable gate assembly 10 may be operable immediately or within minutes of placement on the ground surface. For an automated or otherwise mechanically actuated barrier arm embodiment, portable gate assembly 10 may be operational upon connecting a power source. In some embodiments, the portable gate may include a power source. In some embodiments, the barrier arm may be manually hand-operated between the open and closed positions.

Figure 11:
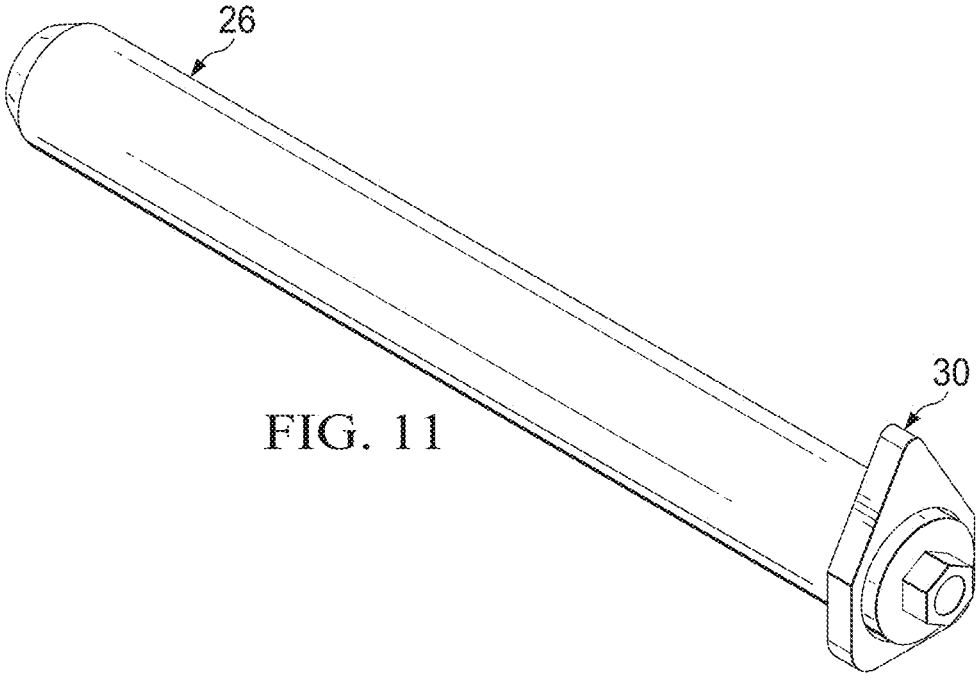
FIG. 11 illustrates a perspective view of an exemplary hinge pin in accordance with one or more aspects of the disclosure.
Figure 12:
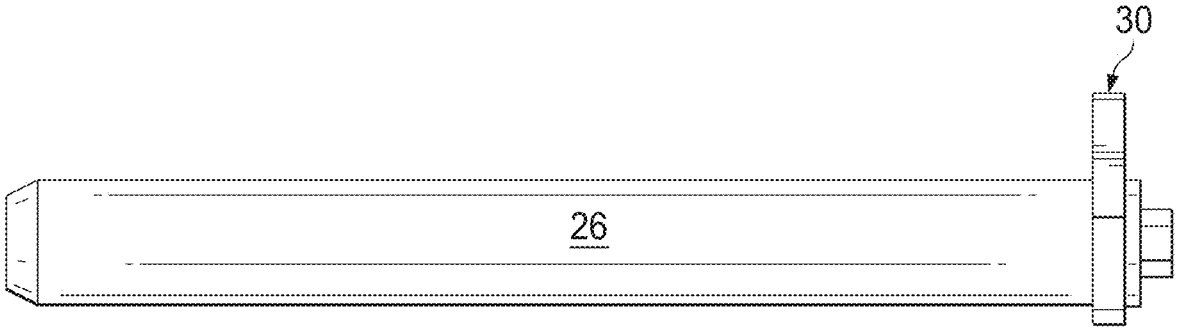
FIG. 12 is a side view of an exemplary hinge pin.
Figure 13:
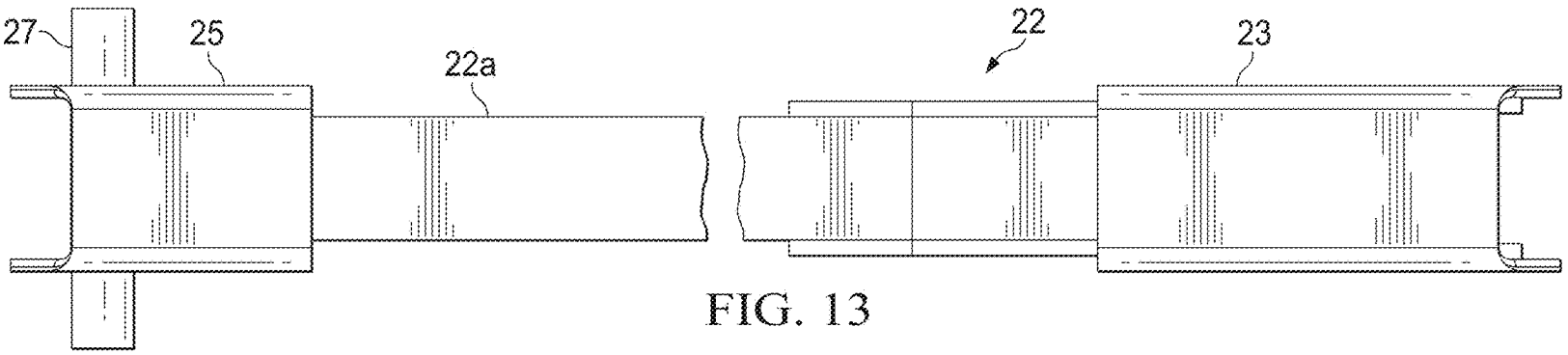
FIG. 13 is a top view of an exemplary barrier beam according to one or more aspects of the disclosure.
Figure 14:
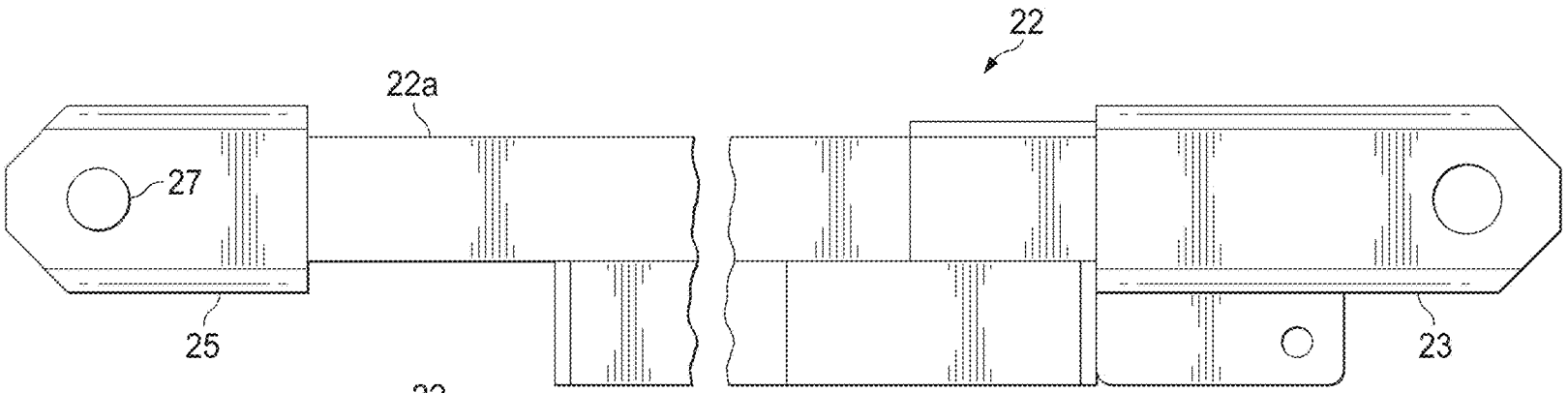
FIG. 14 is a side view of an exemplary barrier extending from a hinge end to a pivot end.
Figure 15:
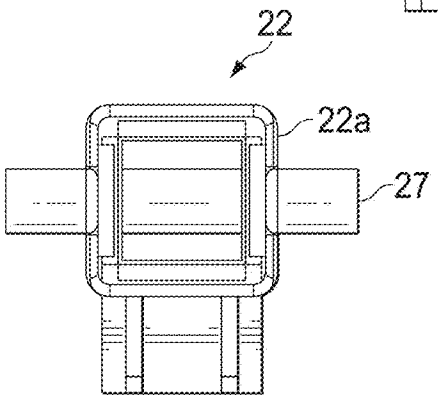
FIG. 15 is an end view of an exemplary barrier member.
Figure 16:
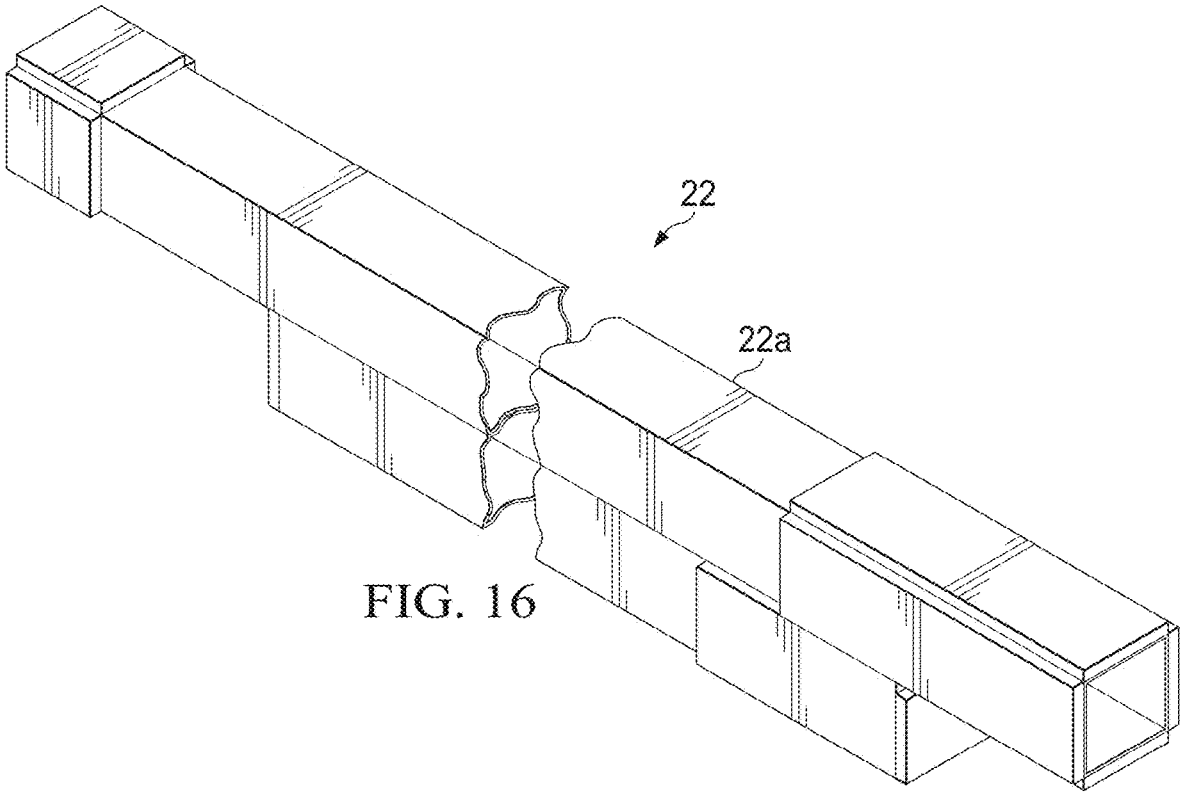
FIG. 16 is a perspective view of a portion of an exemplary barrier member.
Figure 17:
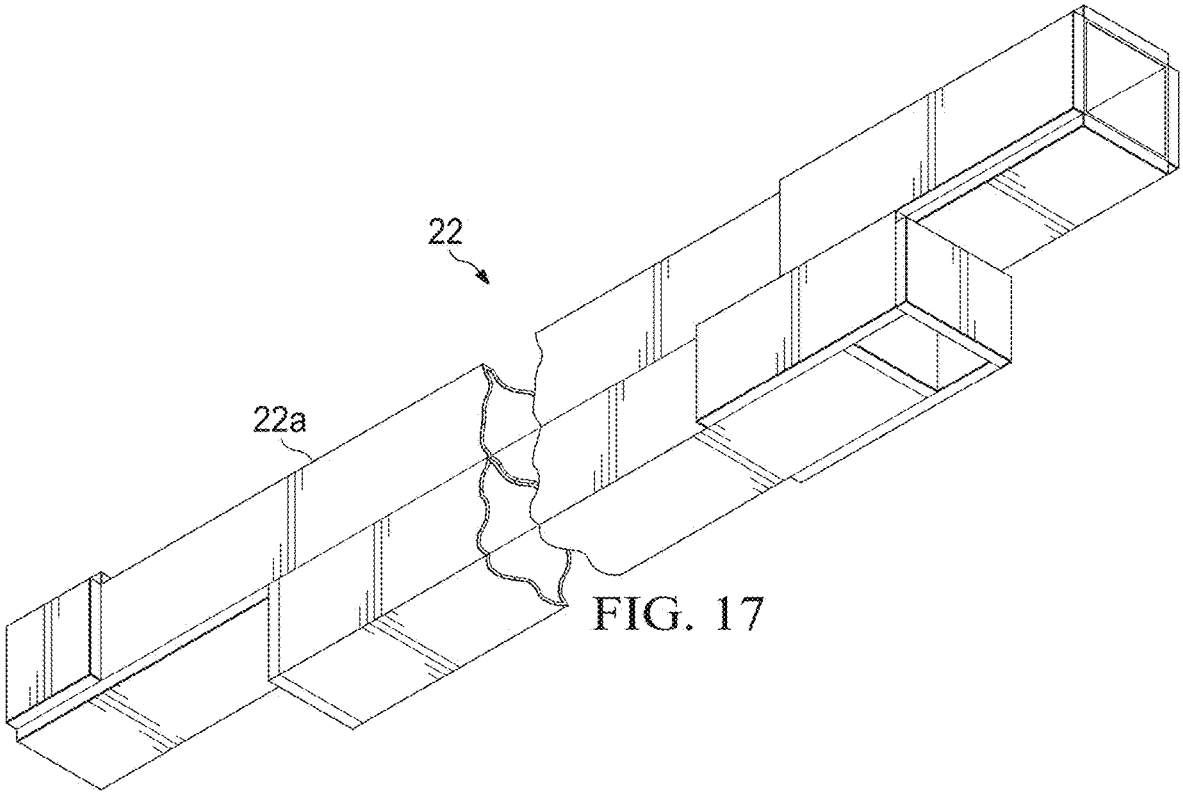
FIG. 17 is another perspective view of a portion of an exemplary barrier member.
Figure 18:
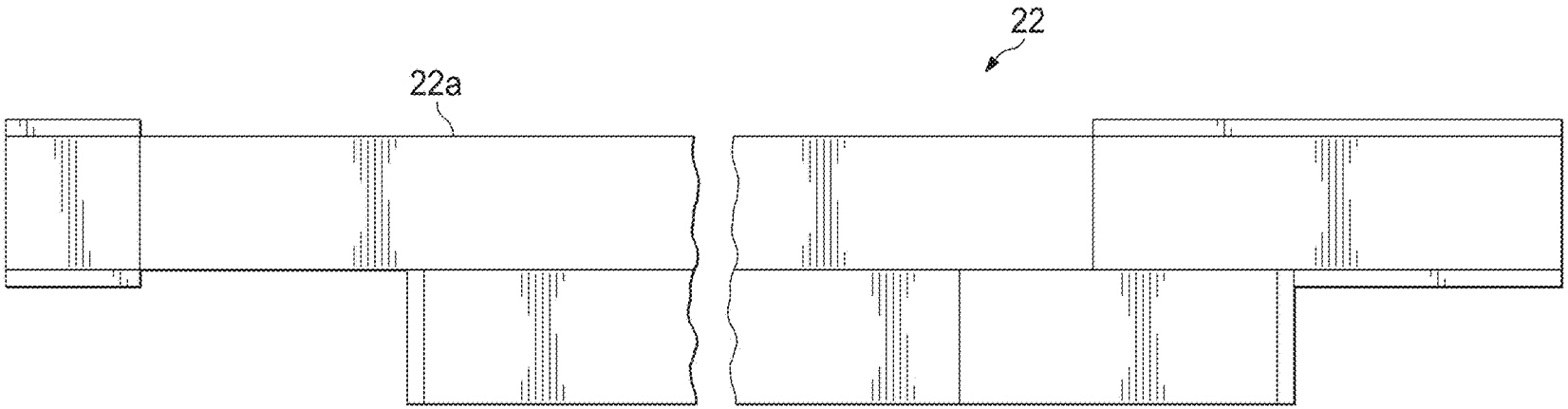
FIG. 18 is a side view of a portion of an exemplary barrier member.
Figure 19:
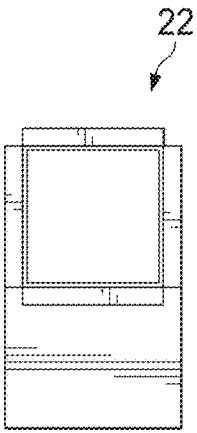
FIG. 19 is an end view of a portion of the exemplary barrier member illustrated in FIG. 18.
Figure 20:
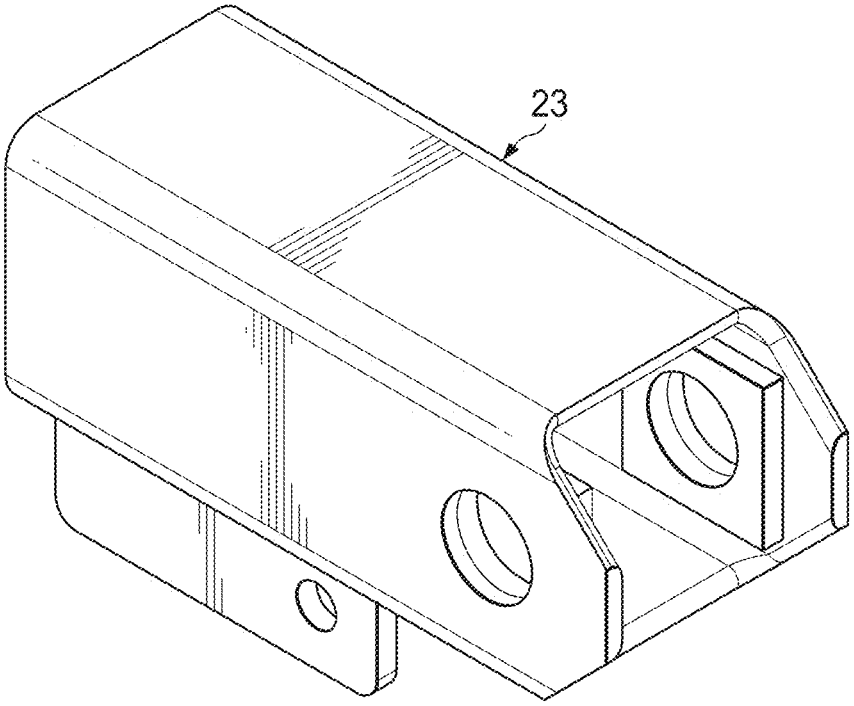
FIG. 20 is an isometric view of an exemplary hinge end of barrier beam according to one or more aspects of the disclosure.
Figure 21:
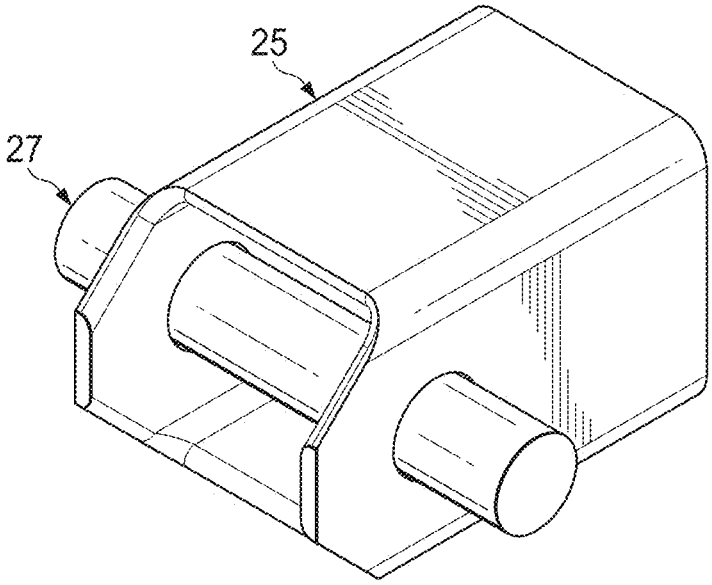
FIG. 21 an isometric view of an exemplary latch end of barrier beam with a latch pin according to one or more aspects of the disclosure.

Referring in particular to FIGS. 3 and 13-21, the illustrated barrier 22 is constructed of or includes a metal beam, identified specifically with reference number 22*a*, extending from a first end 23 (hinge end) to a second end 25 (latch end). Barrier 22 may also include a cable (rope or metal) identified specifically with the reference number 22*b*. Hinge end 23 includes a hinge (pivot) pin 26 (FIGS. 11, 12) that connects barrier 22 to hinge post assembly 18. Latch end 25 of barrier 22, in accordance with some embodiments, includes a latch pin 27 that extends in the axial direction parallel to the flow of traffic and perpendicular to the longitudinal axis of barrier 22. As will be described below with reference to the latch post assembly, in the normally closed position latch end 25 and latch pin 27 of beam 22 are not engaged with the latch post assembly in a manner that hinders or prevents the vertical movement of barrier 22 relative to the latch post assembly. In the normally closed position, the barrier beam is not being impacted by a vehicle and the latch end and latch pin are disposed in the latch post gap between the opposing latch posts of the latch post assembly. When a vehicle impacts barrier 22 with sufficient force, as illustrated for example in FIG. 30, latch end 25 and latch pin 27 will be drawn laterally inward in the direction toward hinge end 23 and hinge post assembly 18 and cause latch pin 27 and latch end 25 to engage with latch post assembly 20 in a manner that prevents or limits the movement of latch end 25 vertically, in the direction away from base 12, and out of engagement with latch post assembly 20. This engagement between latch end 25 and latch post assembly 20 maintains barrier 22 in connection with frame 8 (base 12, hinge post assembly 18, and latch post assembly 20) even if the vehicle impact tips the portable gate assembly 10 as illustrated for example in FIG. 30.

Figure 25:
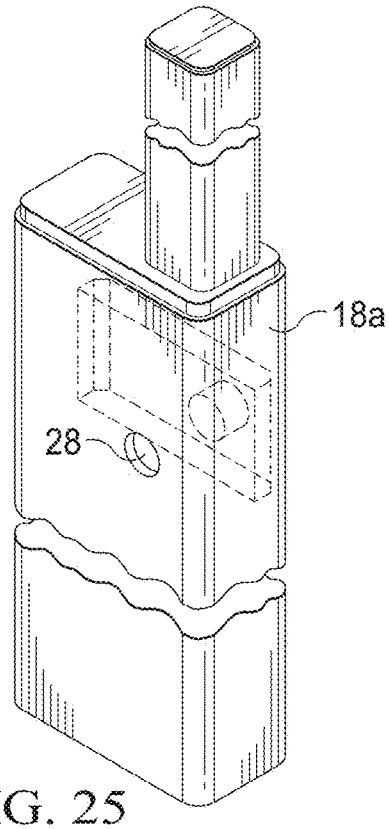
FIG. 25 illustrates an exemplary attack side hinge post of a hinge post assembly according to one or more aspects of the disclosure.
Figure 26:
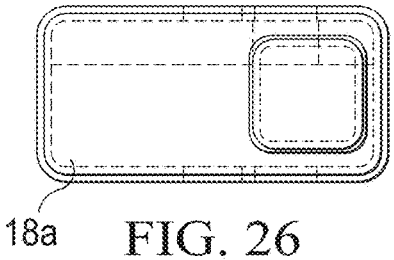
FIG. 26 is a top view of the exemplary attack side hinge post of FIG. 25.
Figure 28:
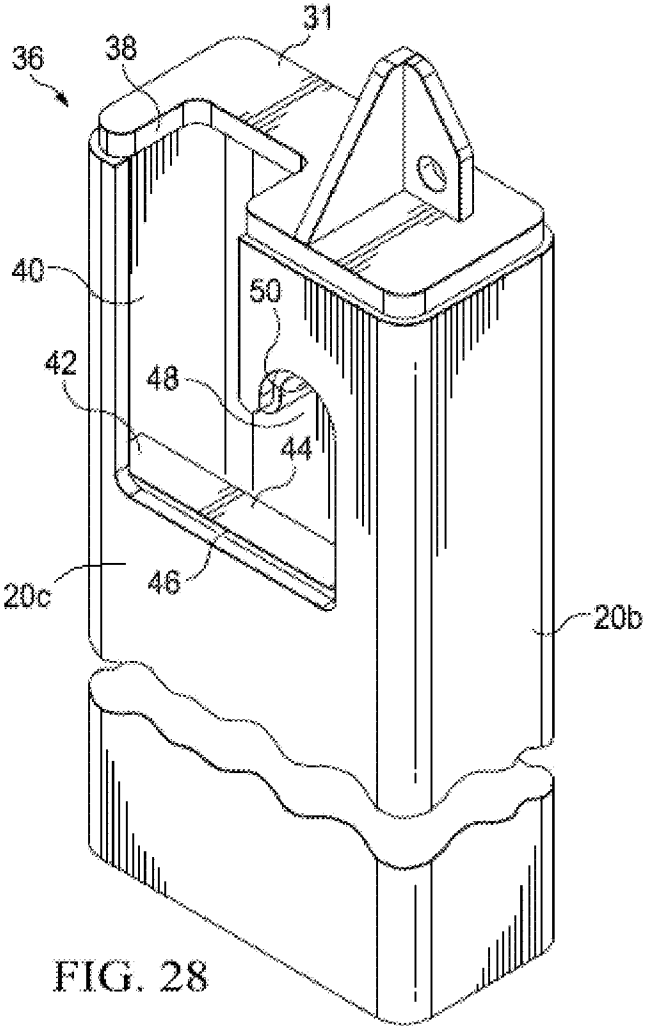
FIG. 28 illustrates an exemplary inside face of a second latch post illustrating an exemplary J-slot.
Figure 27:
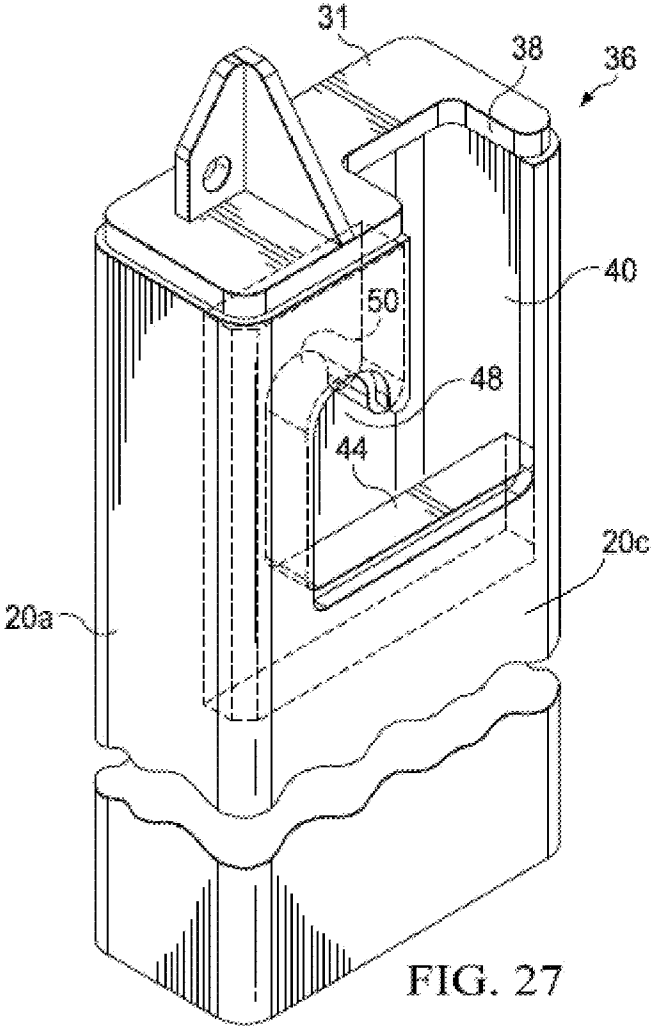
FIG. 27 illustrates an exemplary inside face of a first latch post illustrating an exemplary J-slot according to one or more aspects of the disclosure.

With reference in particular to FIGS. 1-5, 7-9, and 22-26, the illustrated hinge post assembly 18 includes a pair of spaced apart hinge posts 18*a*, 18*b* forming a gap 19 extending parallel to the lateral width of base 12 and in which hinge end 23 of the barrier is positioned with hinge pin 26 connected to both of hinge posts 18*a*, 18*b*. Attack-side hinge post 18*a* includes a passage 28 (FIG. 25) formed through both sides 17*a* and 17*b* (FIGS. 2, 26) such that a stop 30 (e.g., plate) (FIGS. 11, 12) on a first end of hinge pin 26 is located on outer side 17*a* of first hinge post 18*a* opposite from gap 19. In the illustrated examples, hinge post assembly 18 is disposed partially within a housing 32. Hinge post assembly 18 may utilize a single post member.

Figure 2:
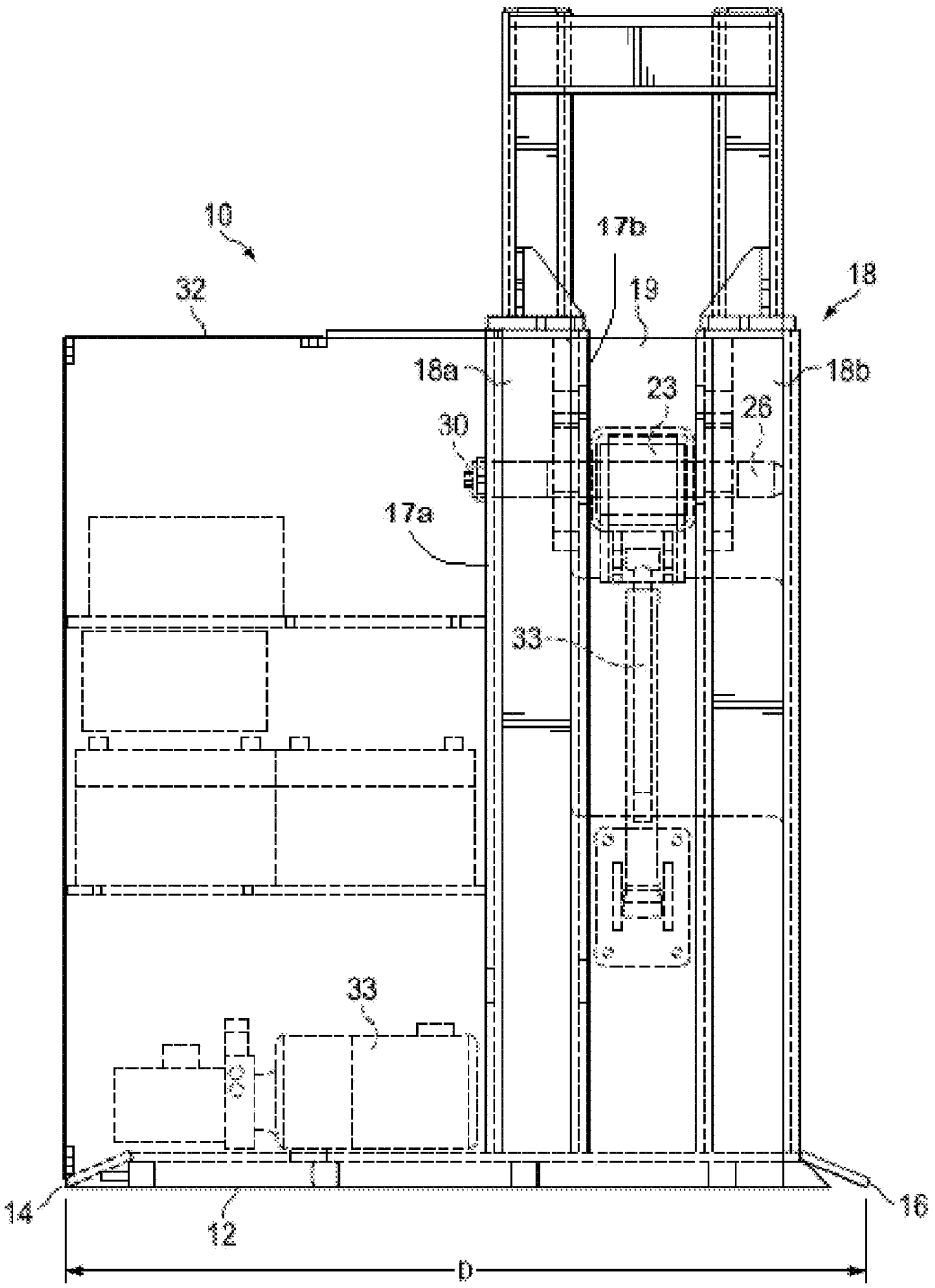
FIG. 2 is a side view from the hinge post side of an exemplary vehicle gate assembly according to one or more aspects of the disclosure.

In FIG. 2, a drive mechanism or actuator 33 is operationally connected with barrier beam 22 to move the barrier from the closed position as shown FIG. 1 to an open position in which barrier beam 22 is moved out of the vehicle passage between the hinge and latch post assemblies.

With reference in particular to FIGS. 1, 3, 4, 6, 7, 8, 10, 22, 27, and 28, the illustrated latch post assembly 20 includes a pair of spaced apart latch posts 20*a*, 20*b* forming a gap 21 extending parallel to the lateral width of the base 12 and in which latch end 25 of barrier 22 is positioned when in the closed position. Latch post gap 21 is formed between the inner or inside faces 20*c* of the respective latch posts 20*a*, 20*b*. For the purpose of description, latch post 20*a* is located on the attack-side of the gap 21 with inner face 20*c* facing away from attack-side edge 14 and protected-side latch post 20*b* is positioned adjacent protected-side edge 16 with its inner face 20*c* facing toward attack-side edge 14. In accordance with some embodiments, latch post assembly 20 may include a housing 34 enclosing at least a portion of latch posts 20*a*, 20*b* and interconnecting latch posts 20*a*, 20*b* which are also attached directly to base 12.

Each of latch posts 20*a*, 20*b* forms a J-slot 36 that is open along inner face 20*c*. The J-slots on the respective latch posts 20*a*, 20*b* are mirror images across gap 21. Each J-slot 36 extends from a first top end 38 open at top side 31 of latch post 20*a*, 20*b* along a first or primary vertical slot 40 to a first bottom end 42 and extends horizontally along a horizontal slot 44 in the direction toward hinge post assembly 18 to a second bottom end 46. In an exemplary embodiment, J-slot 36 further includes a trap or second vertical slot 48 that extends vertically upward, toward top end 31, to a terminal end 50 that is located below top side 31 and closed to top side 31.

In operation, when portable gate assembly 10 is in the normally closed position as illustrated for example in FIG. 29, latch end 25 of barrier 22 is disposed in gap 21 of latch post assembly 20 and latch pin 27 is disposed in primary slot 40. With latch pin 27 located in primary slot 40, barrier 22 cannot be pushed horizontally and moved out of vehicle passage 13 between hinge post assembly 18 and latch post assembly 20, but barrier 22 can be moved vertically out of vehicle passage 13 to open the gate assembly.

When a motor vehicle impacts barrier 22 with sufficient force, barrier 22 will bend and draw latch end 25 with latch pin 27 inward toward hinge post assembly 18. During the impact, latch pin 27 will travel along horizontal slot 44. When latch pin 27 is in horizontal slot 44, or trap 48, barrier 22 is engaged with latch post assembly 20 and it cannot move vertically or horizontally out of engagement with latch post assembly 20. The horizontal and vertical directions are defined generally with reference to base 12 being a bottom, horizontal member of the gate assembly. For example, vertical is substantially perpendicular to base 12 and horizontal is substantially parallel to base 12.

Figure 30:
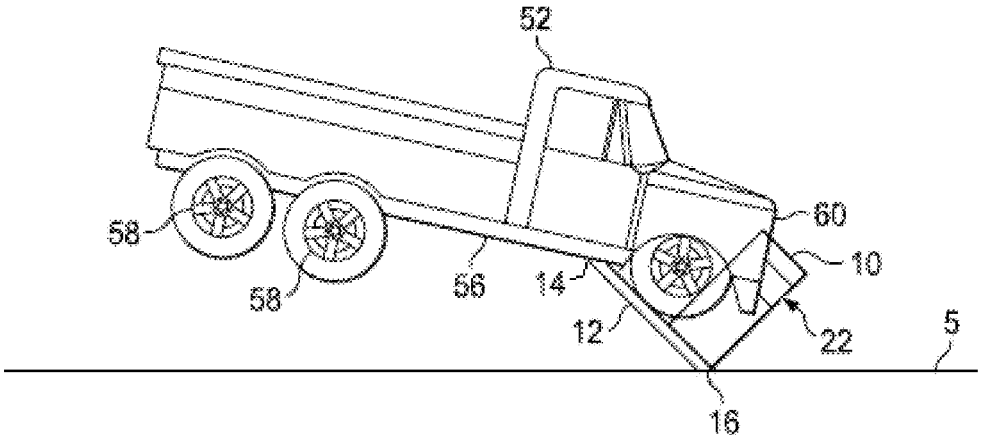
FIG. 30 illustrates an exemplary gate assembly impacted on the attack side by a motor vehicle.

When a vehicle 52 impacts with a sufficient force, portable gate assembly 10 will tip or pivot about protected-side edge 16, as illustrated in FIG. 30, and threat-side edge 14 of base 12 moves upward to engage frame 56 of vehicle 52. This tipping or pivoting action uses the kinetic energy of the impacting vehicle 52 to engage vehicle with gate assembly 10 and to anchor gate assembly 10 to ground surface 5 thereby limiting the penetration of the vehicle. The engagement of gate assembly 10 with vehicle 52 tends to interfere with the steering of vehicle 52 via the front wheels 54, lifting the front wheels, and limits the motorized power of the vehicle by lifting rear wheels 58 off of the ground surface during the impact. The pivoting action of portable gate assembly 10 tends to direct front end 60 of the vehicle downward toward ground surface 5 as opposed to upward as can occur with many barriers.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method of arresting a forward motion of a moving vehicle travelling on a surface with a vehicle barrier, the vehicle barrier comprising a base plate, a first post, a second post, and a beam, wherein the base plate is positioned on the surface and has a width extending laterally to define a vehicle passage between the first post and the second post and has a depth extending perpendicular to the width from a front edge of the base plate to a back edge of the base plate, and wherein the beam, when in a blocking position, is positioned proximate the back edge and extends across the vehicle passage from the first post to the second post, the method comprising:

contacting, with the beam in the blocking position, the moving vehicle with the beam, where the forward motion is in a direction from the front edge toward the back edge; and rotating the base plate due to the contacting the moving vehicle with the beam causing the base plate to contact a frame of the vehicle:

wherein the second post comprises a J-slot formed in a face of the second post, the J-slot comprising a primary vertical slot extending from an open top end of the primary vertical slot in a top of the second post to a bottom end of the primary vertical slot and a horizontal slot extending from the bottom end toward the first post, the horizontal slot comprising a trap extending toward the top of the second post; and wherein the beam comprises a first end pivotally attached to the first post and a second end comprising a pin disposed in the J-slot when the beam is in the blocking position.

2. The method of claim 1, wherein the pin is positioned in the primary vertical slot when the beam is in the blocking position and prior to the contacting the moving vehicle with the beam; and moving the pin into the horizontal slot in response to the contacting the moving vehicle with the beam.

3. The method of claim 2, wherein:

the moving vehicle has a weight of about 15,000 pounds; and the forward motion of the vehicle is stopped within about 98 feet or less after the contacting the moving vehicle with the beam.

4. The method of claim 1, wherein the first post and the second post are positioned on top of the base plate.

5. The method of claim 1, wherein the forward motion of the vehicle is stopped within about 98 feet or less after the contacting the moving vehicle with the beam.

6. The method of claim 1, wherein the forward motion of the moving vehicle is approximately 28 miles per hour or greater.

7. The method of claim 1, wherein the moving vehicle has a weight of about 15,000 pounds.

8. The method of claim 1, wherein:

the moving vehicle has a weight of about 15,000 pounds; and the forward motion of the vehicle is stopped within about 98 feet or less after the contacting the moving vehicle with the beam.

9. A method of arresting a forward motion of a moving vehicle travelling on a surface with a vehicle barrier, the vehicle barrier comprising a base plate, a first post, a second post, and a beam, wherein the base plate is positioned on the surface and has a width extending laterally to define a vehicle passage between the first post and the second post and has a depth extending perpendicular to the width from a front edge of the base plate to a back edge of the base plate, wherein the second post comprises a slot formed in a face of the second post, the slot comprising a primary vertical slot extending from an open top end of the primary vertical slot in a top of the second post to a bottom end of the primary vertical slot and a horizontal slot extending from the bottom end toward the first post, and wherein the beam comprises a first end attached to the first post and a second end comprising a pin, the method comprising:

pivoting the beam to a blocking position with the pin located in the primary vertical slot;

contacting, with the beam in the blocking position, the moving vehicle with the beam;

moving the pin into the horizontal slot in response to the contacting the moving vehicle with the beam; and rotating the base plate in response to the contacting the moving vehicle with the beam causing the base plate to contact a frame of the vehicle.

10. The method of claim 9, wherein the forward motion of the vehicle is stopped within about 98 feet or less after the contacting the moving vehicle with the beam.

11. The method of claim 10, wherein the forward motion of the moving vehicle is approximately 28 miles per hour or greater.

12. The method of claim 10, wherein the moving vehicle has a weight of about pounds or greater.

13. The method of claim 9, wherein the pin extends orthogonal to a longitudinal axis of the beam.

* * * * *